US012059087B2

(12) United States Patent
Samuelson

(10) Patent No.: US 12,059,087 B2
(45) Date of Patent: Aug. 13, 2024

(54) FLEXIBLE ELEMENT FOR FORMING A PIECE OF DISPOSABLE CUTLERY

(71) Applicant: SKY-LIGHT A/S, Varde (DK)

(72) Inventor: Hans Samuelson, Kungälv (SE)

(73) Assignee: SKY-LIGHT A/S, Varde (DK)

( * ) Notice: Subject to any disclaimer, the term of this patent is extended or adjusted under 35 U.S.C. 154(b) by 309 days.

(21) Appl. No.: 17/618,804

(22) PCT Filed: May 18, 2020

(86) PCT No.: PCT/SE2020/050514
§ 371 (c)(1),
(2) Date: Dec. 13, 2021

(87) PCT Pub. No.: WO2020/251441
PCT Pub. Date: Dec. 17, 2020

(65) Prior Publication Data

US 2022/0240699 A1 Aug. 4, 2022

(30) Foreign Application Priority Data

Jun. 14, 2019 (EP) ..... 19180412

(51) Int. Cl.
*A47G 21/04* (2006.01)
*A47G 21/02* (2006.01)
*A47G 21/00* (2006.01)

(52) U.S. Cl.
CPC ..... *A47G 21/04* (2013.01); *A47G 21/02* (2013.01); *A47G 2021/002* (2013.01); *A47G 2400/10* (2013.01)

(58) Field of Classification Search
None
See application file for complete search history.

(56) References Cited

U.S. PATENT DOCUMENTS 3,792,810 A * 2/1974 Tingley ..... B65D 5/106 229/128
3,828,999 A 8/1974 Humphrey
(Continued)

FOREIGN PATENT DOCUMENTS

AU 2009238313 6/2011
CN 201816929 5/2011
(Continued)

OTHER PUBLICATIONS

International Search Report for PCT/SE2020/050514 mailed Jun. 29, 2020, 5 pages.
(Continued)

*Primary Examiner* — Hwei-Siu C Payer
(74) *Attorney, Agent, or Firm* — NIXON & VANDERHYE

(57) ABSTRACT

Flexible element for forming a piece of disposable cutlery, especially a spoon, including an elongated body made from thin, bendable material including a handle and acting portions, each with a free end. A first bending line on the body extends longitudinally from the handle portion free end towards the acting portion, so the body may be bent longitudinally and in the bent position, the working position, the handle portion is V-shaped or U-shaped. The body has an elongated opening including at one side a lip, pointing from the handle portion free end towards the acting portion. A fifth bending line extends transverse to the first bending line, visually dividing the body into the handling and acting portions. The fifth bending line is positioned so when the body is folded along such, a part of the acting portion free end can be inserted into the opening, behind the lip.

20 Claims, 4 Drawing Sheets

(56) References Cited

U.S. PATENT DOCUMENTS

| | | | | |
|---|---|---|---|---|
| 4,615,120 | A | 10/1986 | Newman | |
| 5,705,212 | A * | 1/1998 | Atkinson | B65D 51/247 426/115 |
| 2009/0205209 | A1 | 8/2009 | Tovar | |
| 2012/0228319 | A1* | 9/2012 | Cook | B65D 5/46088 220/771 |
| 2014/0069933 | A1 | 3/2014 | Cross | |
| 2014/0259697 | A1* | 9/2014 | Cross | A47G 21/04 30/324 |
| 2016/0297604 | A1 | 10/2016 | Gabler | |
| 2016/0309934 | A1* | 10/2016 | Stewart-Stand | A47G 21/02 |
| 2018/0070750 | A1* | 3/2018 | Li | B65D 3/08 |

FOREIGN PATENT DOCUMENTS

| | | | |
|---|---|---|---|
| CN | 201831519 | | 5/2011 |
| CN | 205267735 | | 6/2016 |
| DE | 202018003477 | | 8/2020 |
| EP | 1 142 522 | | 10/2001 |
| JP | 2000-166734 | A | 6/2000 |
| JP | 2011-117932 | A | 6/2011 |
| JP | 2000-166734 | | 6/2020 |
| KR | 20-0386861 | | 6/2005 |
| WO | 93/18693 | | 9/1993 |
| WO | 2020/043251 | | 3/2020 |

OTHER PUBLICATIONS

Written Opinion of the ISA for PCT/SE2020/050514 mailed Jun. 29, 2020, 9 pages.

Extended EP Search Report for EP19180412.9 dated Jan. 8, 2020, 8 pages.

Office Action issued in Polish Patent Application No. P.439990 dated Apr. 6, 2022.

* cited by examiner

FLEXIBLE ELEMENT FOR FORMING A PIECE OF DISPOSABLE CUTLERY

CROSS-REFERENCE TO RELATED APPLICATIONS

This application is the U.S. national phase of International Application No. PCT/SE2020/050514 filed May 18, 2020 which designated the U.S. and claims priority to EP Priority Application No. 19180412.9 filed Jun. 14, 2019, the entire contents of each of which are hereby incorporated by reference.

BACKGROUND OF THE INVENTION

Field of the Invention

The following invention relates to a flexible element for forming a piece of disposable cutlery, especially a spoon. The flexible element has an elongated spoon body, made from thin, bendable material, such as cardboard, the body comprising a handle portion having a first free end and an acting portion having a second free end, and the body comprising at least one first bending line on the body, extending in the longitudinal direction of the body from substantially the free end of the handle portion, towards the acting portion, facilitating that the body may be bent longitudinally and that in the so bent position, the working position, the handle portion then has a substantially V-shaped or U-shaped cross section.

Description of the Related Art

Disposable cutlery similar to the above described is known e. g. from the European Patent Application EP 1142522, which shows a disposable spoon, made of plastic material. The spoon is intended to be delivered together with a food container for helping the buyer of the food container to eat the contents of the container. In EP 1142522 it is shown how the spoon is secured to a round food cup, positioned around the outside of the container and fastened by a piece of tape. The process to secure the spoon to the container seems to be a cumbersome and complicated process. Also, in the light of modern standards, the use of tape and plastic material is considered undesirable and unfriendly to the environment. A better solution for securing a supplement such as cutlery to a food container is sought after.

SUMMARY OF THE INVENTION

The cutlery of the present invention is shown in the form of a spoon, which is designed to be made from thin-walled, cardboard material and is especially used for catering purposes and with food packaging. The new inventive spoon body has an elongated opening arranged in the vicinity of the free end of the handle portion, the opening comprising at its one side a lip-shaped means, pointing from the free end of the handle portion towards the acting portion, and the body also has a fifth bending line, extending substantially transverse to the first bending line, visually dividing the body into the handling portion and the acting portion, whereby the position of the fifth bending line is chosen so that when the body is folded along the fifth bending line, a part of the free end of the acting portion can be readily inserted at or into the opening, behind the lip-shaped means, or shorter, the lip, thereby securing the body in a folded position. This secured, folded position is an advantage, making the spoon more manageable when storing the spoon body on a small food container, having a size where the entire food content of the container can be eaten directly by the buyer. There are disposable spoons known, which are foldable, having means for securing them in a folded position for packaging reasons, but those spoons are made of plastic, and plastic is no longer desirable for making disposable items.

The inventive cutlery spoon is easy to store in such a secured, folded state, requiring less storage space than not folded, is comfortable to use and can be disposed of without being a threat to the environment, due to the possibility to choose material that is friendly to the environment, such as cardboard.

It is therefore an object of the present invention to provide disposable cutlery which may be manufactured at even lower cost than the known disposable cutlery, has good environmentally friendly properties and is storable in a practical, foldable position.

The flexible element according to the invention may be manufactured very easily at very low cost, e.g. from rolls of cardboard. Due to its space saving properties in the folded position, the cutlery spoon may be sold with various products so that a piece of cutlery is always available together with the product. Especially, the inventive spoon may be sold together with a yoghurt cup, stored in the cup cover, preferably secured to the cover inside by an inner cover seal, between the cover and the inner seal, so that there is no longer the need for users to carry a spoon with them. The cover then is preferably designed with a recess, dimensioned to be able to receive the folded spoon body. In order to eat the yoghurt, the user may simply separate the spoon from the yoghurt cup cover, unfold the flexible element and bring the handle portion to its bent position by bending the handle part at the longitudinal bending line and forming a spoon. After use the flexible element may be disposed of. Of course, it is possible to reuse the flexible element.

According to an alternative embodiment of the invention, the elongated opening has two ends, and at each end a bending line is situated, extending substantially perpendicular to the first bending line. This facilitates the insertion of the free end of the acting portion under the lip at the opening in the body.

In another embodiment of the invention, there are at least two first bending lines in the body, extending substantially in parallel to each other. This facilitates that the handle portion can be bent in a way that makes the cross section of the handle portion have a substantially U-shape, making the handle portion somewhat more rigid. It also enables more simple ways of designing means of securing the handle portion in a state for use.

It is also helpful to the end user if the material of the body is weakened along the bending lines, thus facilitating bending along the bending lines. The bending lines can also be marked by printing or the like, making bending even more simple and indicating for the user how to use the flexible element.

As indicated above, it is also helpful when using the inventive spoon if the handle portion comprises retaining means for retaining the handle portion in its use position, bent along the first bending line. Preferably the retaining means is formed integrally with the body. In one such embodiment the retaining means comprises a retaining element, which in the working position is lockable in a force-locking and/or form-fitting manner in a corresponding recess or opening in the handle portion, thereby retaining the handle portion in its use position. An embodiment is shown, where the retaining element comprises a second tongue formed integrally with one flange of the handle portion, which when bent is formed to a V-shaped or U-shaped cross-section of the handle portion, which second tongue comprises a least one holding portion with two mutually opposing, first lateral projections, on top of a tongue middle section, which section is narrowed relative to the holding portion, and that the other flange of the handle portion comprises the recess, opposite to the retaining element. The width of the recess corresponds to the width of the narrowed section. The tongue may thus be flexed for insertion of the narrowed section into the recess in the bent position of the handle portion, thereby engaging the outer wall of the second flange with its holding portion and thereby again retaining the handle portion in its bent, use position. The recess can also be designed with second projections, situated at the entry opening of the recess and pointing towards each other.

In order to look like and work as a spoon, it is also advantageous, if the body is widened towards the free end of the acting portion.

Basically, the flexible element according to the invention is suitable for forming a spoon, a fork or a knife. However, it is especially suitable for forming a spoon. When the element forms a fork, it is designed with teeth at the acting portion free end and when it forms a knife, its body acting portion free end is provided with a serrated edge, at least at one side.

Basically, it is sufficient that only one first bending line is provided, although two first bending lines is more user friendly. However, in certain embodiments, in the area of the acting portion extra bending lines can be arranged extending from the area of the first bending line(s) towards the free end of the acting portion. The additional bending lines make it easier to bend the flexible element, e. g. for giving the acting portion a spoon-like shape. The pattern of the bending lines depends on the desired shape of the acting portion, e.g. to form a deep spoon or a shallow spoon, and can be designed by the person skilled in the art.

BRIEF DESCRIPTION OF THE DRAWINGS

The invention shall be described in more detail below in relation to an embodiment shown in the attached drawings in which.

DESCRIPTION OF THE PREFERRED EMBODIMENTS

Figure 1:
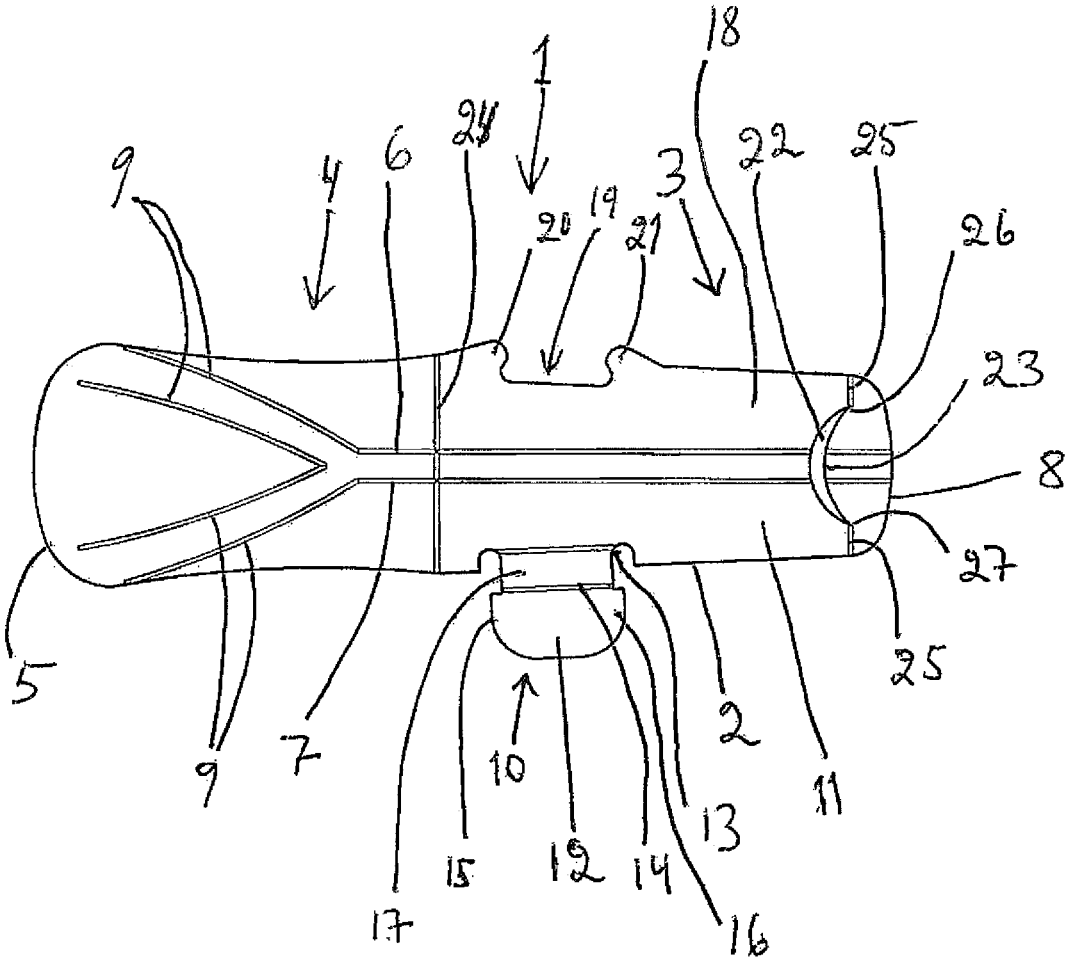
FIG. 1 shows a top plan view of an embodiment of a flexible element according to the invention in its unbent and unfolded position.

In the drawings a flexible element for forming a piece of disposable cutlery, a spoon, is shown as an example, although a fork or a knife could be equally designed and described, using the invention. The flexible element comprises an elongated, substantially rectangular body 1, having a substantially longitudinal direction and a rim 2, made from thin, bendable material, e. g. cardboard. The body 1 comprises a handle portion 3 and an acting portion 4. As can be seen from FIG. 1, the body 1 is widened towards the free end 5 of the acting portion 4 with the free end 5 of the acting portion being rounded outwardly.

In the embodiment of FIG. 1 two first bending lines 6 and 7 extend from the free end 8 of the handle portion 3 towards the acting portion 4 such that the body 1 may be bent along the bending lines 6,7 so that in the bent position the handle portion 3 has a substantially U-shaped cross section. This will be more explained below, especially in connection with FIG. 4.

In the area of the acting portion 4 second bending lines 9 extend from the area of the ends of the first bending lines 6 and 7 towards the free end 5 of the acting portion 4 wherein the second bending lines 9 converge towards each other towards the free end 5 of the acting portion 4. These second bending lines facilitate for the user to form a spoon bowl. In order to make it easier for the user to bend the body 1 the material of the body 1 can be weakened by scratching or cutting it on its surface along the bending lines 6, 7 and 9.

Figure 4:
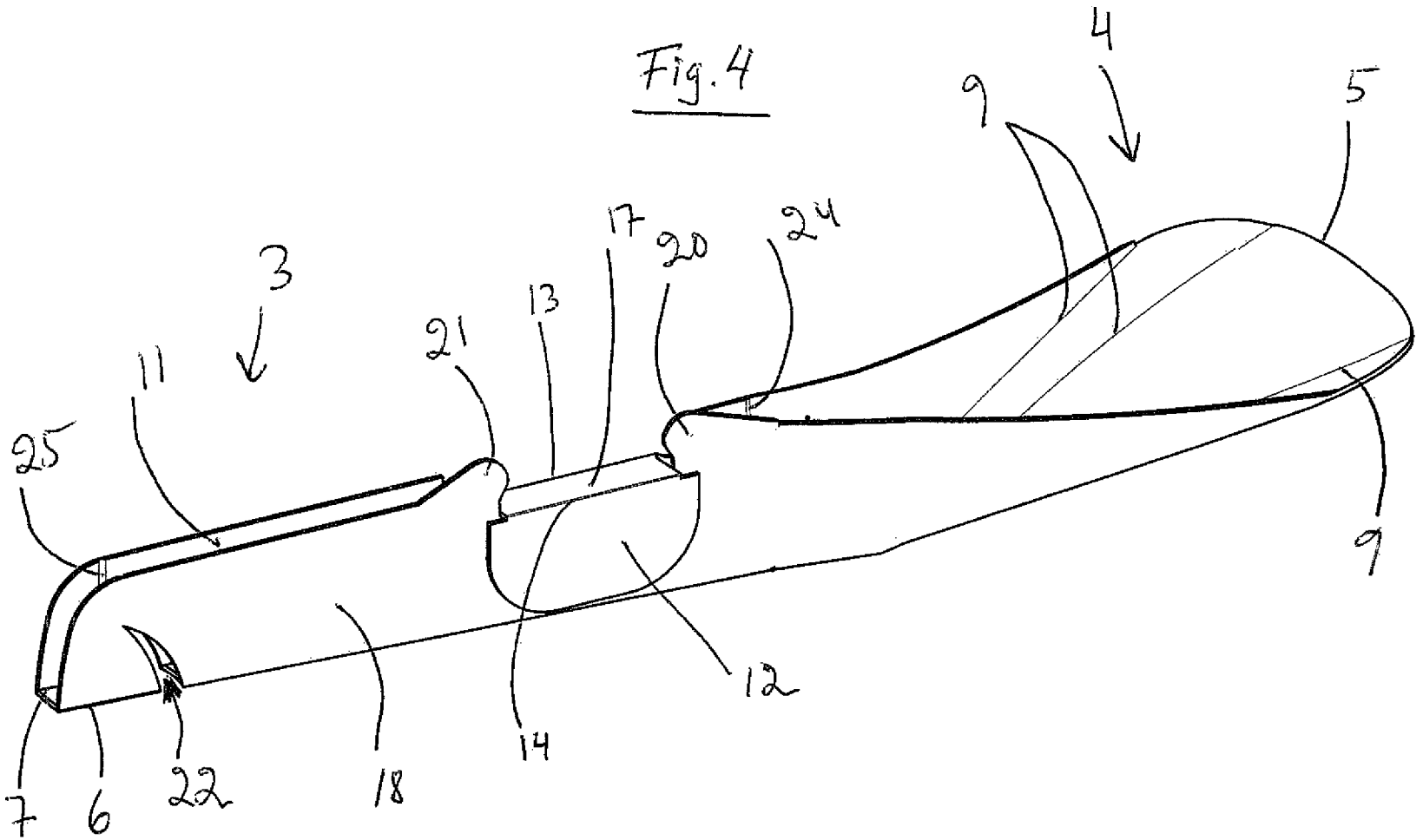
FIG. 4 shows the embodiment of FIG. 1 in its unfolded, use position, having the U-shaped handle portion secured in a bent, use state and the action portion bent along additional bending lines for creating a shape like a spoon.

In order to bring the flexible element into its bent position for forming a spoon, the body 1 of the flexible element is bent along first bending lines 6 and 7 such that in the bent position the handle portion 3 cross profile is formed to a substantially U-shape as can be seen from FIG. 4. Due to the second bending lines 9 in the acting portion 4 it will obtain a shape very similar to the shape of a conventional spoon, forming a small depression. In order to retain the body 1 in its bent position the user preferably manipulates the retaining means 10.

The retaining means 10 is formed integrally with a first flange 11 of the body 1 and comprises a tongue 12, which is twice bendable relative to the flange 11 and itself along third and fourth bending lines 13 and 14. The tongue 12 has two lateral projections 15 and 16 and between the bending lines 13,14 the tongue 12 comprises a narrowed section 17. Opposite to the tongue 10 the other flange 18 comprises a recess 19 which has a bottom substantially parallel to the longitudinal direction of the body 1. The recess 19 is sized and positioned such that in the bent position, having the U-shaped cross section of the handle portion 3 of the body 1, the narrowed section 17 of the tongue 12 being insertable into the recess 19. After insertion of the tongue 12 into the recess 19, lateral projections 15, 16 engage the outer wall of the flange 18, as can be seen from FIG. 4. The tongue 12 may be bent along the fourth bending line 14 to be positioned flush with the outer wall of the flange 18, as shown in FIG. 4. Thereby the body 1 is retained in a safe and easy manner in its bent position as can be seen in FIG. 4. The recess 19 is designed with second projections 20, 21, situated at the entry opening of the recess and pointing substantially towards each other. The second projections 20,21 can with a little force be passed when inserting the narrowed section 17 of the tongue 12 into the recess and will thereafter secure the tongue 12 in the recess 19.

Figure 3:
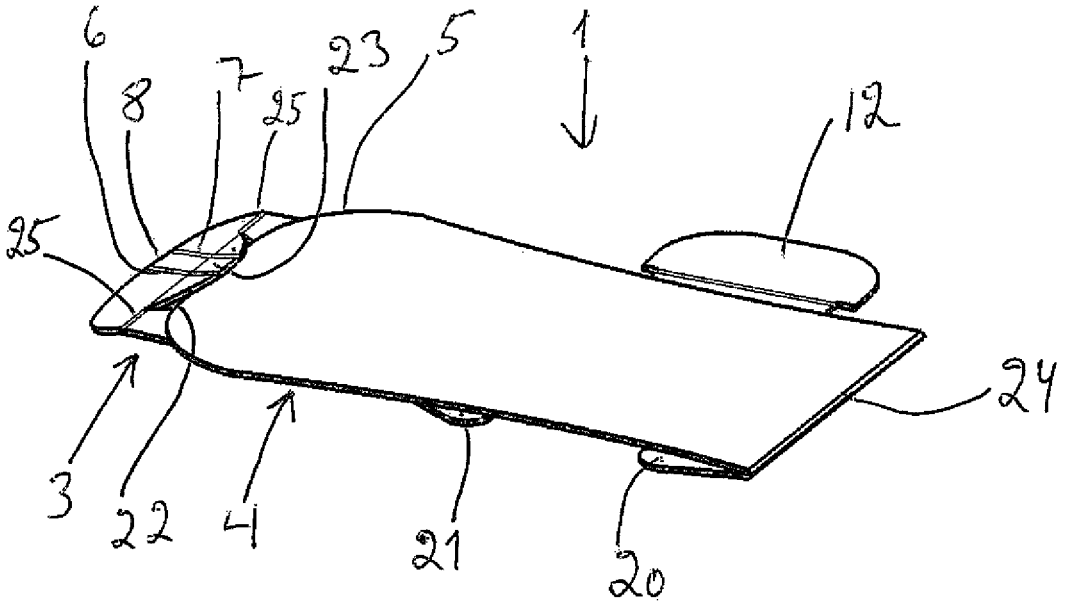
FIG. 3 shows a view of the embodiment of FIG. 1 in its folded position in a smaller scale than FIG. 1.

In FIG. 1 it can be seen that the body 1 has a substantially "smiling mouth"-shaped, elongated opening 22 arranged in the vicinity of the free end 8 of the handle portion 3. The opening 22 comprises at its one side (the right side in FIG. 1) a lip-shaped portion, a lip 23, pointing from the free end 8 of the handle portion 3 towards the acting portion 4. Further, a fifth bending line 24 extends substantially transverse to the first bending lines 6,7, visually dividing the body 1 into the handling portion 3 and the acting portion 4. The position of the fifth bending line is chosen so that when the body 1 is fully flat folded along the fifth bending line, the handling portion and acting portion are so positioned relative to each other that a part of the free end 5 of the acting portion 4 can be inserted into the opening 22, behind the lip 23, as can be seen in FIG. 3, thus ensuring that the full folding position of the body 1 is achieved and kept. In order to facilitate the securing manipulation of the lip 23, sixth bending lines 25 are arranged at the respective ends 26 and 27 of the lip 23, being substantially perpendicular the longitudinal axis of the body 1.

Figure 2:
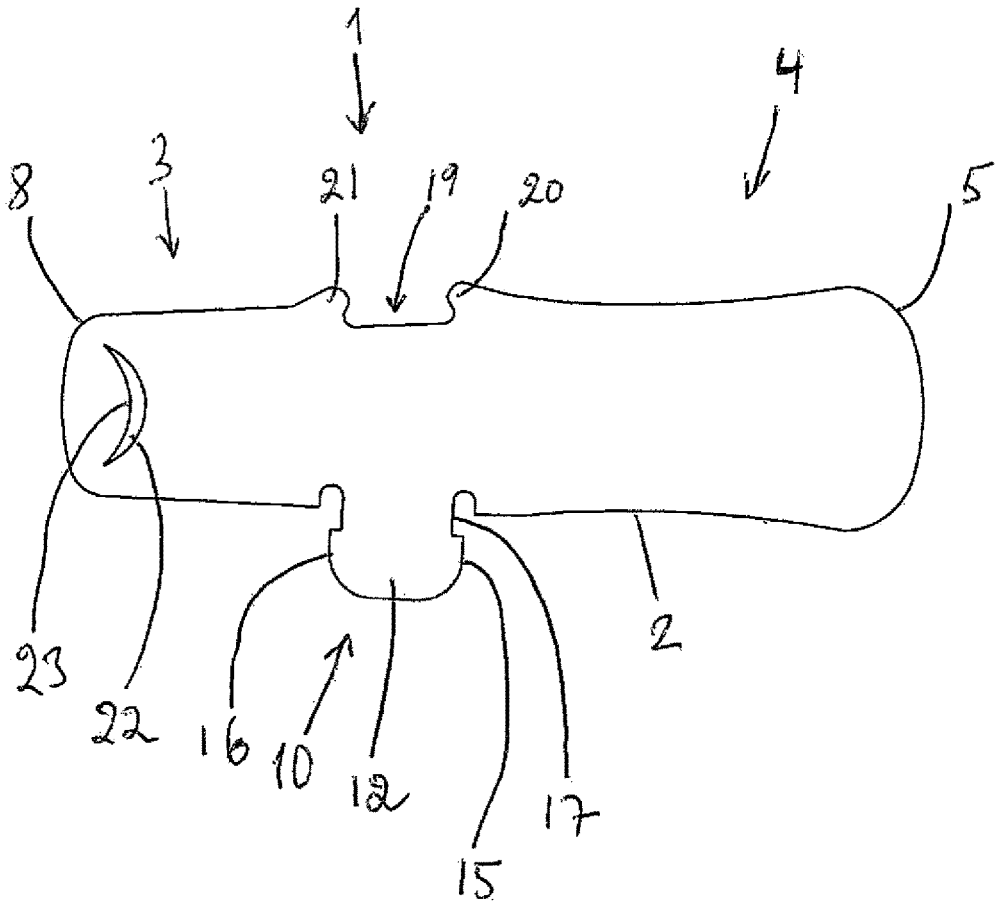
FIG. 2 shows a rearside plan view of the embodiment of FIG. 1.

FIG. 2 shows the rearside of the same body 1 as shown and described above in connection with FIG. 1. The same numbers have been used to show the same details of the embodiment. It is possible that a physical example of the invention would show the bending lines more, or less, weakly.

FIG. 3. shows the body 1 in a folded position, the lip 23 positioned on the outside of the acting portion 4, securing the free end 5 of the acting portion under it so that the spoon body keeps fully folded. The visible parts of the details shown in FIGS. 1 and 2 are denoted with the same reference numbers.

FIG. 4. shows the spoon body 2 in a use position, the body being bent along the bending lines 6 and 7 and 9, and the retaining first tongue and its narrowed section 17 being in the retaining position, with the top of the first tongue being positioned flush with the flange 18.

The invention, as explained above in the description itself and in connection to the attached figures, is not limited to the described example but is defined by the patent claims. Examples of what can be different from what is described and disclosed are discussed in the following.

The spoon according to the invention does not have to be sold in connection to any other goods, but can be sold as a single tool for eating, especially for campers. However, one apparent use for the spoon according to the invention is that the spoon body may be received in its folded position in a cavity of e.g. a yoghurt cup cover, for example positioned in a recess of the yoghurt cup lid, secured there by a seal. The invention also works with only one first bending line, even if the manipulation when forming the spoon will be a little different. The opening 22 can be freely designed and the shape of the lip can be of different design as long as a part of the free end of acting portion 4 can be inserted beyond or under it. The lip could for example be split into two or more parts, not necessarily but preferably symmetrically positioned. The opening can be just a cut through as long as there is a lip, free to be put out in a locking position in relation to a part of the free end 5 of the acting portion 4, the end 5 being positioned at the then more visible opening 22. The scale of the figures on the different drawings is not exactly the same all over, since the drawings are meant only for explaining the invention.

The material used for forming the flexible element could include a coating, e.g. a moisture barrier coating or laminate, of course an environment friendly one, and being usable in connection with food for eating by people. It could also be a coating that is durably (thermo-) formable during the producing process in order to help shaping the acting part, especially when it is part of a spoon.

The flexible elements are of course suitable for machine manufacturing, e.g. punched from rolls or blanks in state of the art ways.

The invention claimed is:

1. A flexible element for forming a piece of disposable cutlery, comprising an elongated body made from thin, bendable material comprising a handle portion with a free end and an acting portion with a free end, wherein at least a first bending line on the body extends in the longitudinal direction of the body from an area of the free end of the handle portion towards the acting portion, facilitating that the body can be bent longitudinally such that in a so bent position, a working position, the handle portion then has a V-shaped or U-shaped cross section, and wherein an additional bending line extends transverse to the first bending line, visually dividing the body into the handle portion and the acting portion, wherein an elongated opening is arranged in the vicinity of the free end of the handle portion, the opening comprising at one side thereof a lip-shaped means, pointing from the free end of the handle portion towards the acting portion, whereby the position of the additional bending line is chosen so that when the body is folded along the additional bending line, a part of the free end of the acting portion can be inserted into the opening, behind the lip-shaped means.

2. The flexible element according to claim 1, wherein the elongated opening has two ends and at each end of the two ends a lip bending line is situated, extending perpendicular to the first bending line and facilitating bending of the lip-shaped means.

3. The flexible element according to claim 2, wherein the elongated opening has two ends and at each end of the two ends a lip bending line is situated, extending perpendicular to the first bending line and facilitating bending of the lip-shaped means.

4. The flexible element according to claim 2, wherein there are at least two first bending lines extending in parallel to each other.

5. The flexible element according to claim 2, wherein the material of the body is weakened along the bending lines.

6. The flexible element according to claim 2, wherein the body is marked along the bending lines by prints.

7. The flexible element according to claim 2, further comprising retaining means for retaining the body in the working position.

8. The flexible element according to claim 1, wherein there are at least two first bending lines extending in parallel to each other.

9. The flexible element according to claim 8, wherein the material of the body is weakened along the bending lines.

10. The flexible element according to claim 8, wherein the body is marked along the bending lines by prints.

11. The flexible element according to claim 8, further comprising retaining means for retaining the body in the working position.

12. The flexible element according to claim 1, wherein the material of the body is weakened along the bending lines.

13. The flexible element according to claim 12, wherein the body is marked along the bending lines by prints.

14. The flexible element according to claim 12, further comprising retaining means for retaining the body in the working position.

15. The flexible element according to claim 1, wherein the body is marked along the bending lines by prints.

16. The flexible element according to claim 1, further comprising retaining means for retaining the body in the working position.

17. The flexible element according to claim 16, wherein the retaining means is formed integrally with the body.

18. The flexible element according to claim 16, wherein the retaining means comprises a first tongue which in the working position is retainable in a force-locking and/or form-fitting manner in a recess or an opening in the body thereby retaining the body in the bent position.

19. The flexible element according to claim 18, wherein the first tongue is formed integrally with one flange of the V-shaped or U-shaped cross-section of the handle portion, which first tongue has a narrowed section, that the other flange of the cross-section comprises the recess, whereas the first tongue is flexed for insertion of the narrowed section into the recess in the bent position of the body, thereby engaging the outer wall of the other flange thereby retaining the body in the bent position.

20. The flexible element according to claim 1, wherein the body widens towards the free end of the acting portion.

* * * * *